United States Patent [19]

Sakane et al.

[11] Patent Number: 4,731,283

[45] Date of Patent: Mar. 15, 1988

[54] WATERPROOF CLOTH AND PROCESS FOR PRODUCTION THEREOF

[75] Inventors: Isamu Sakane, Ohtsu; Satuski Kawauchi, Shiga; Tsuneo Gemba, Okayama; Minoru Maekawa, Toyonaka, all of Japan

[73] Assignees: Kuraray Co., Ltd., Okayama; I.S.T. Corporation, Shiga, both of Japan

[21] Appl. No.: 915,569

[22] Filed: Oct. 6, 1986

[30] Foreign Application Priority Data

Oct. 7, 1985 [JP] Japan ..... 60-223960

[51] Int. Cl.[4] ..... B32B 17/10; B32B 27/08; B32B 27/28; D06M 15/256

[52] U.S. Cl. ..... 428/251; 156/308.6; 156/309.6; 428/253; 428/286; 428/421; 428/422

[58] Field of Search ..... 428/251, 421, 422, 286, 428/253; 156/308.6, 309.6

[56] References Cited

U.S. PATENT DOCUMENTS

| | | | |
|---|---|---|---|
| 2,539,329 | 1/1951 | Francis et al. | 428/268 |
| 3,928,703 | 12/1975 | Cook | 428/268 |
| 4,526,830 | 7/1985 | Ferziger et al. | 428/251 |
| 4,610,918 | 9/1986 | Effenberger et al. | 428/251 |
| 4,645,709 | 2/1987 | Klare | 428/251 |

*Primary Examiner*—James C. Cannon

*Attorney, Agent, or Firm*—Wenderoth, Lind & Ponack

[57] ABSTRACT

A waterproof cloth comprising a base cloth made of heat-resistant fibers having a fluorine resin adhering to their surface and a film of a fluorine resin fused integrally to at least one surface of the base cloth. The waterproof cloth can be produced by laying the film on the base cloth and heating them under pressure.

15 Claims, No Drawings

WATERPROOF CLOTH AND PROCESS FOR PRODUCTION THEREOF

This invention relates to a fluorine resincontaining waterproof cloth.

In the prior art, a general waterproof cloth is made by impregnating or coating a fabric composed of synthetic fibers such as polyester, polyamide or polyvinyl alcohol fibers or natural fibers such as cotton with a paste or solution of a polymer such as a vinyl chloride polymer, chlorosulfonated polyethylene or synthetic rubber, or bonding a film of the polymer to the fabric. In recent years, non-combustible or flame-retardant waterproof sheets have attracted attention, and many waterproof sheets based on non-combustible or flame-retardant fibers or resins have been developed. Of particular interest is a waterproof cloth comprising glass fibers treated with a tetrafluoroethylene resin (to be referred to as PTFE) which was developed to impart non-combustibility and durability. This waterproof cloth is produced by impregnating a fabric of glass fibers with an aqueous dispersion of PTFE optionally containing a filler, drying the fabric, sintering it at a temperature above 327° C. which is the melting point of PTFE, and repeating the above operation several times to several tens of times in order to obtain a thick PTFE layer.

Since the fluorine resin has poor film-forming ability, the aforesaid time-consuming step is necessary in order to form a pinhole-free fluorine resin layer of the desired thickness integrally on the glass fiber base cloth. Furthermore, the need to repeat the above step leads to inefficiency and a very high cost of production.

On the other hand, in order to reduce the number of the impregnating and sintering steps and thus the cost of production, a method was proposed in which the thickness of the fluorine resin layer obtained by one impregnation is increased by using a fluorine resin dispersion containing glass beads (Japanese Laid-Open Patent Publication No. 13496/1974 and West German Patent No. 2,315,259 corresponding to it). It is still difficult by this method to obtain a product having satisfactory waterproof characteristics by one treatment, and the treatment should be repeated several times.

The common defect of these methods is that the treated cloth should be repeatedly sintered at a temperature above 327° C., the melting point of PTFE. The glass fiber base cloth has a heat-resistant temperature of about 640° C., but when repeatedly exposed to high temperatures above 327° C., it increasingly undergoes degradation and its strength is reduced to about one-third of the original strength. This adversely affects the waterproof cloth product obtained.

It is an object of this invention to provide a waterproof cloth composed of heat-resistant fibers, particularly glass fibers, and a fluorine resin at low cost, and to suppress a reduction in the strength of the base cloth of the resulting waterproof cloth, by reducing the number of treating steps.

According to this invention, the above object is achieved by a waterproof cloth comprising a base cloth made of heat-resistant fibers having a fluorine resin adhering to their surface and a film of a fluorine resin fused integrally to at least one surface of the base cloth.

In a preferred embodiment, the present invention provides a waterproof cloth composed of a base cloth woven or knitted from yarns of glass fibers coated with a fluorine resin and a film of a fluorine resin fused integrally to one or both surfaces of the base cloth.

The waterproof cloth of the invention can be produced, for example, by impregnating yarns of the heat-resistant fibers with a dispersion of the fluorine resin, drying and sintering the impregnated fibers, knitting or weaving a base cloth from the resulting yarns having the fluorine resin adhering to their surface, laying the film of the fluorine resin on one or both surfaces of the base cloth, and heating the assembly under pressure to thereby fuse the film to the base cloth.

In the process of this invention, yarns (to be sometimes referred to hereinbelow as "coated yarns") of heat-resistant fibers having the fluorine resin adhering to their surface obtained by impregnating heat-resistant multifilament yarns (single yarns or ply yarns) continuously with a dispersion of the fluorine resin, drying the impregnated yarns and sintering them to a temperature above the melting point of the resin are used as starting yarns for knitting or weaving the base cloth. The heatresistant fibers may be those fibers whose properties are not significantly deteriorated under the conditions employed in sintering the fluorine resin. Examples include glass fibers, ceramic fibers, carbon fibers, aramide fibers, arylate fibers, and metal fibers. In view of non-combustibility, properties and cost, the glass fibers are most preferred. Application of the process of this invention to the glass fibers is of great significance since despite their availability at low prices, the glass fibers have low adhesion to fluorine resins and on standing at high temperatures, gradually decrease in strength.

Illustrative of the fluorine resin are difluoroethylene resin (to be peferred to as PVdF), trifluoroethylene resin (to be peferred to as PCTFE), 4,6-fluoroethylene resin (to be peferred to as FEP), tetrafluoroethylene/-perfluoroalkyl vinyl ether copolymer resins (to be referred to as PFA) and PTFE. The fluorine resin is used as a dispersion in water or a solvent. The dispersion of the fluorine resin has a solids concentration of 20 to 80% by weight. If its pick-up of the fluorine resin on the fibers is adjusted to 5 to 40% by weight, preferably 10 to 30% be weight, based on the fibers, the fibers are fully coated with the resin after sintering. For example, in the care of a multifilament, each single filament is coated with, or embedded in, the fluorine resin. If the pick-up is less than 5% by weight, the above state of the fibTrs cannot be created, and the adhesion of the film of the fluorine resin to the fibers is insufficient. As a result, the waterproof cloth finally obtained has poor flexural durability. If the pick-up exceeds 40% by weight, the cost of treatment increases, and because of the need to repeat the impregnating step and the sintering step, the strength of the cloth will be reduced. Hence, the pick-up of the fluorine resin is preferably within the aforesaid range irrespective of the type of the heat-resistant fibers.

To maintain the strength of the yarns of the heat-resistant fibers, particularly glass fibers, the constituent monofilaments should preferably have the smallest possible diameter, particularly a diameter of not more than 6 microns.

The waterproof cloth of this invention can be produced by making a woven or knitted fabric, such as a plain-weave fabric, a twill fabric or a wale-course inserted raschel fabric, as a base cloth, and bonding a film of a fluorine resin such as PVdF, PCTFE, PTFE, FEP or PFA to the fabric at high temperatures. Bonding under heat can be suitably effected by passing an assembly of the fabric and the film laid on it between two rollers kept at a high temperature (the laminating method), or by bonding them by a high temperature hot press.

When a film if tetrafluoroethylene resin is used as the fused film on one surface of the base cloth and a film of 4,6-fluoroethylene resin or a tetrafluoroethylene/perfluoroalkyl vinyl ether copolymer resin as the fused film on the other surface of the base cloth in this invention, an advantage in processing can be obtained in that when the waterproof cloth is bonded to itself by heat-fusing its one surface to its other surface, the heat fusion can be carried out easily.

A waterproof cloth which substantially meets the objects of this invention can be obtained also by a process which comprises making a woven or knitted fabric from the heat-resistant fibers, impregnating the fabric with a dispersion of the fluorine resin, drying the impregnated fabric so that the pick-up of the fluorine resin is adjusted to 5 to 40% by weight based on the heat-resistant fibers, sintering the resulting base cloth, repeating the above impregnating, drying and sintering steps several times, and finally fusing the fluorine resin film integrally to one or both surfaces of the base cloth. The individual heat-resistant fibers in the resulting waterproof cloth sometimes remain uncoated with the fluorine resin. Such a waterproof cloth does not always have a high adhesion strength between the base cloth and the fluorine resin film and its flexural strength is not sufficient. However, as compared with conventional fluorine resin-coated waterproof cloths, both the pick-up of the fluorine resin and the number of the impregnating and sintering steps to be repeated can be decreased. The fibers can therefore be prevented from decreasing in strength, and the cost of production can be curtailed by simplification of the steps.

One characteristic feature of this invention is that the fluorine resin film is fused integrally to at least one surface of the base cloth composed of the heat-resistant fibers having the fluorine resin adhering to their surface. This feature contributes to a decrease in the pick-up of the fluorine resin and in the number of sintering operations to be repeated, the latter leading to prevention of a reduction in the strength of the waterproof cloth. Since the process steps are simplified, the cost of production can be curtailed. Another feature of the invention is that the woven or knitted fabric composed of the coated yarns (i.e., yarns of heat-resistant fibers, such as glass fibers, having the fluorine resin adhering to their surfaces) is used as the base cloth. This feature serves for the production of a waterproof cloth which has markedly improved strength, particularly flexural strength, and a high adhesion strength between the fluorine resin film and the base cloth and is therefore difficult of delamination, and in which the fluorine resin layer is flexible. If the fluorine resin film is fused directly to a base cloth composed of glass fibers having no fluorine resin adhering thereto, the adhesion strength between the glass fibers and the fluorine resin film is very low because the affinity between the glass fibers and the fluorine resin is low. In contrast, when glass fibers (as multifilament yarns or twisted ply yarns) are treated in advance with a dispersion of the fluorine resin in accordance with the present invention, the individual single filaments are embedded in the fluorine resin and integrated, and therefore, delamination between each of the glass filaments and the coated resin does not easily occur. Consequently, then the fluorine resin film is fused to a base cloth made of such coated yarns, the fluorine resin of the coated yarns and the film are fully integrated, and the adhesion strength between the base cloth and the film is enhanced. Furthermore, since the individual glass fibers are coated and reinforced with the fluorine resin and do not make direct contact with one another, the glass fibers do not undergo damage when the waterproof cloth is bent, and thus, the flexural strength of the waterproof cloth increases. Moreover, since the glass fibers are already reinforced with the fluorine resin and the adhesion between the base cloth and the film is good, a pre-formed thin film of the fluorine resin may also be used as the waterproofing layer. In a conventional waterproof cloth made, for example, by the conventional method described in the above-cited Japanese Laid-Open Patent Publication No. 13496/1974, the proportion of the glass fibers is 20 to 30% by weight, whereas it can be increased to 40% by weight or more in the waterproof cloth of this invention. Hence, the waterporoof cloth of this invention has flexibility. In addition, since it is not necessary in the process of this invention to repeat the sintering of the fluorine resin many times as is in the prior art, there is little likelihood of the strength of the base cloth being reduced during treatment and the resulting waterproof cloth has high strength.

The waterproof cloth of this invention can also find application as a heat-resistant belt, a releasing cloth and a lining of chimneys and the like in addition to an ordinary waterproof material.

The following examples illustrate the present invention more specifically. These examples are not to be construed as limiting the scope of the invention.

EXAMPLE 1

Glass fibers (ECD 150½) were impregnated with an aqueous dispersion of PTFE (solids concentration 60% by weight), dried in a constant temperature vessel at about 200° C. and left to stand for 12 minutes in a constant temperature open at 345° C. The above procedure was repeated three times to obtain yarns of glass fibers coated with PTFE. The coated yarns had a PTFE pick-up of 17%. A plain weave fabric was woven by using the resulting coated yarns as warps and wefts both at a density of 31/inches. An FEP film having a thickness of 50 micrometers was laid over the plain-weave fabric and the assembly was passed between two pressurized rolls heated at 270° C. to obtain a waterproof cloth having the FEP film intimately adhering to one surface of the fabric. The resulting waterproof cloth had a tensile strength of 120 kg/3 cm, a tear strength of 4.1 kg (single tank method), a film-base cloth adhesion strength of 8 kg/3 cm, and an MIT flexural durability of 10649 cycles (load 1 kg/cm), and could fully withstand use as a film structure. The product contained 56% of the glass fibers.

COMPARATIVE EXAMPLE 1

Example 1 was repeated except that a plain-weave fabric made of glass yarns not coated with PTFE was used as the base cloth. The product had a film-base cloth adhesion strength of only 0.3 kg/3 cm, and could not be used as a waterproof cloth.

EXAMPLE 2

A PTFE film having a thickness of 50 micrometers was laid over both surfaces of the same base cloth as in Example 1 made from yarns of the PTFE-coated glass fibers, and the assembly was pressed for 5 minutes under a pressure of 20 kg/cm$^2$ by a hot plate press at 350° C., and then cooled for 3 minutes by a cooling press. The resulting product had a film-base cloth adhesion strength of 9.5 kg/3 cm and an MIT flexural durability of 15250 cycles and could be used as a waterproof cloth. The product contained 41.7% of the glass fibers.

EXAMPLE 3

Glass fibers (ECB 150-4/3) were impregnated with a dispersion of FEP (solids concentration 50%), dried in a constant temperature vessel at 180° C. and then heated in a constant temperature oven at about 300° C. This procedure was repeated two times to obtain coated glass yarns having an FEP pick-up of 12%. A 2/2 mat fabric as a base cloth was made by using these coated yarns as warps and wefts at a density of 17/inch. PFA was extruded from a T-die extruder and simultaneously laminated to both surfaces of the fabric to obtain a product consisting of the base cloth and a PFA film having a thickness of 0.37 mm adhering to both surfaces of the base cloth. The product had a tensile strength of 205 kg/3 cm, a tear strength of 9.8 kg, a film-base cloth adhesion strength of 10.3 kg/3 cm and an MIT flexural durability of 15827 cycles and was excellent as a waterproof cloth. The product contained 55% of the glass fibers.

COMPARATIVE EXAMPLE 2

A 2/2 mat fabric was produced as a base cloth by using glass fibers (ECB 150-4/3) as warps and wefts. The fabric was impregnated with an aqueous dispersion of PTFE containing 20% by weight, based on PTFE, of glass beads having a diameter of less than 10 microns (resin concentration 60% by weight), dried at about 200° C., and then sintered at 345° C. for 15 minutes. This procedure was repeated four times. The resulting product was brownish and a slightly roughened surface. It had a tensile strength of 185 kg/3 cm, a tear strength of 3.5 kg, a PTFE-base cloth adhesion strength of 3.2 kg/3 cm and an MIT flexural durability of 2152 cycles. The physical properties and durability of the product were inferior to those of the product of this invention.

EXAMPLE 4

Coated yarns having a PTFE pick-up of 35% were produced from glass fibers (ECD 75-1/5) by the same method as in Example 1. By using the coated yarns as wales and courses, a wale-course inserted raschel knitted fabric (wales 24/inch, courses 20/inch) was made. Yarns of glass fibers (ECB 300-1/0) having a PTFE pick-up of 5% were used as knitting yarns for the raschel fabric. The knitting yarns was used in a single denbigh stitch. PCTFE was placed on both surfaces of the raschel fabric as a base cloth, and the assembly as consolidated under heat and pressure at a pressure of 10 kg/cm$^2$ by a hot plate press at 240° C. The product gave a slightly hard feel but was completely integrated. It had a film thickness of 0.85 mm, a tear strength of 60 kg, a film-base cloth adhesion strength of 8 kg/3 cm, and an MIT flexural durability of 28491 cycles. It was a little bit too hard for use as a waterproof cloth, but could be used as a film structure. The product contained 45% of the glass fibers.

EXAMPLE 5

Glass fibers (ECDE 75½) were impregnated with an aqueous dispertion of PVdF, dried at 170° C., and sintered at 220° C. to obtain coated yarns having a PVdF pick-up of 3%. A plain-weave fabric was made by using these coated yarns as warps and wefts at a density of 30/inch. PVdF was extruded and simultaneously laminated onto the resulting fabric as a base cloth from a T-die extruder to obtain a product having a film thickness of 0.45 mm. The product had a tensile strength of 281 kg/3 cm, a tear strength of 8.2 kg, a film-base cloth adhesion strength of 6.4 kg/3 cm and an MIT flexural durability of 8655 cycles. The product contained 55% by weight of the glass fibers.

EXAMPLE 6

The same base cloth as used in Example 1 was used. A PTFE film haveng a thickness of 100 micrometers prepared by powder molding was bonded to one surface of the base cloth by the laminating method, and a film of FEP or PFA having a thickness of 50 micrometers was bonded to the other surface of the base cloth by the laminating method. This, two products were produced. The product containing PTFE/FEP had a film-base cloth adhesion strength (adhering width 3 cm) of 7.3 kg/8.7 kg, and an MIT flexural durability of 23245 cycles. The product containing PTFE/PFA had a film-base cloth adhesion strength (adhering width 3 cm) of 7.5 kg/9.8 kg and an MIT flexural durability of 26650 cycles. The products contained 48% by weight of the glass fibers.

Both of these products could be bonded by a heat sealing machine at 150° C. under 10 kg/cm$^2$. The shear strength of the product containing PTFE/FEP was 96 kg/3 cm and that ofthe product containing PTFE/PFE was 112 kg/3 cm. In all cases, an excellent bonding efficiency could be obtained.

EXAMPLE 7

A plain-weave fabric having the same texture as in Example 1 was made by using the glass fibers of Example 1 without coating them with PTFE. The fabric was impregnated with an aqueous dispersion of PTFE (solids concentration 60% by weight), dried in a constant-temperature vessel at about 200° C., and left to stand for 12 minutes in a constant-temperature oven at 345° C. The above procedure was repeated three times to obtain a glass fiber base cloth having PTFE adhering thereto. The PTFE pick up of this base cloth was 25%. A FEP film having a thickness of 50 micrometers was closely bonded to the base cloth as in Example 1. The resulting product had a tensile strength of 115 kg/3 cm, a tear strength of 3.5 kg, a film-base cloth adhesion strength of 5 kg/3 cm, an MIT flexural durability of 4755, and could be used as a waterproof cloth. The product contained 53% of the glass fibers.

COMPARATIVE EXAMPLE 3

Instead of fusing the FEP film integrally to the plain-weave fabric made of yarns of glass fibers coated with PTFE in the method described in Example 1, the plain-weave fabric was impregnated with an aqueous dispersion of PTFE (solids concentration 60% by weight), dried in a constant-temperature vessel at about 200° C., and left to stand for 12 minutes in a constant-temperature oven at 350° C. This procedure was repeated five times. The total pick-up of PTFE was 70% by weight based on the glass fibers. Otherwise, a waterproof cloth was produced in the same way as in Example 1. Its tensile strength and tear strength were only 60% of those of the product obtained in Example 1.

When the aforesaid procedure was repeated less than 4 times, the coated layer of the product did not have a sufficient waterproofing effect.

What is claimed is:

1. A waterproof cloth comprising (1) a base cloth woven or knitted from treated yarns formed by impregnating yarns of heat-resistant fibers with a dispersion of fluorine resin, drying the impregnating yarns, and sintering the dryed yarns to adhere fluorine resin to the surfaces thereof and (2) a film of a fluorine resin fused integrally to at least one surface of the base cloth.

2. The waterproof cloth of claim 1 wherein the base cloth is woven or knitted from yarns of the heat-resistant fibers coated with the fluorine resin.

3. The waterproof cloth of claim 1 wherein the heat-resistant fibers are glass fibers.

4. The waterproof cloth of claim 2 wherein the yarns are multifilament yarns of glass fibers.

5. The waterproof cloth of claim 3 wherein the amount of the fluorine resin adhering to the glass fibers is 5 to 40%.

6. The waterproof cloth of claim 1 wherein the fluorine resin is at least one resin selected from the group consisting of di-fluoroethylene resin, trifluoroethylene resin, tetrafluoroethylene resin, 4,6-fluoroethylene resin and tetrafluoroethylene/perfluoroalkyl vinyl ether copolymer resins.

7. The waterproof cloth of claim 1 wherein a film of tetrafluoroethylene resin is fused to one surface of the base cloth, and a film of a 4,6-fluoroethylene resin or a tetrafluoroethylene/perfluoroalkyl vinyl ether copolymer resin, to the other surface of the base cloth.

8. The waterproof cloth of claim 3 wherein the proportion of the glass fibers is at least 40% by weight.

9. A process for producing a waterproof cloth, which comprises impregnating yarns of heat-resistant fibers with a dispersion of a fluorine resin, drying the impregnated yarns and sintering them to form yarns having the fluorine resin adhering to their surface, weaving or knitting a base cloth from the resulting yarns, laying a film of a fluorine resin on one or both surfaces of the base cloth, and heating the assembly under pressure to fuse the film to one or both surfaces of the base cloth.

10. The process of claim 9 wherein the heat-resistant fibers are glass fibers.

11. The process of claim 10 wherein the yarns are multifilament yarns of glass fibers.

12. The process of claim 9 wherein the fluorine resin is at least one resin selected from the group consisting of difluoroethylene resin, trifluoroethylene resin, tetrafluoroethylene ressin 4,6-fluoroethylene resin and tetrafluoroethylene/perfluoroalkyl vinyl ether copolymer resins.

13. The process of claim 9 wherein a film of tetrafluoroethylene resin is fused to one surface of the base cloth, and a film of a 4,6-fluoroethylene resin or a tetrafluoroethylene/perfluoroalkyl vinyl ether copolymer resin, to the other surface of the base cloth.

14. The waterproof cloth of claim 4 wherein the amount of the fluorine resin adhering to the glass fibers is 5 to 40%.

15. The waterproof cloth of claim 4 wherein the proportion of the glass fibers is at least 40% by weight.

* * * * *